US009904240B1

(12) United States Patent
Yamashita

(10) Patent No.: US 9,904,240 B1
(45) Date of Patent: Feb. 27, 2018

(54) IMAGE-FORMING APPARATUS AND PROCESS CARTRIDGE

(71) Applicant: FUJI XEROX CO., LTD., Tokyo (JP)

(72) Inventor: Takayuki Yamashita, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/453,244

(22) Filed: Mar. 8, 2017

(30) Foreign Application Priority Data

Sep. 26, 2016 (JP) ..... 2016-187500

(51) Int. Cl.
*G03G 15/00* (2006.01)
*G03G 21/18* (2006.01)

(52) U.S. Cl.
CPC ..... *G03G 21/1814* (2013.01); *G03G 15/751* (2013.01)

(58) Field of Classification Search
CPC ... G03C 1/733; G03G 15/751; G03G 21/1814
See application file for complete search history.

(56) References Cited

U.S. PATENT DOCUMENTS 5,298,617 A 3/1994 Nukada et al.
5,302,479 A 4/1994 Daimon et al.
5,459,004 A 10/1995 Katsumi et al.
2010/0158561 A1* 6/2010 Mitsumori ..... G03G 5/10 399/111
2014/0045112 A1* 2/2014 Shoji ..... G03C 1/733 430/56

FOREIGN PATENT DOCUMENTS

| | | | |
|---|---|---|---|
| EP | 0 710 893 | A1 | 5/1996 |
| JP | 4-189873 | A | 7/1992 |
| JP | 5-98181 | A | 4/1993 |
| JP | 5-140472 | A | 6/1993 |
| JP | 5-140473 | A | 6/1993 |
| JP | 5-263007 | A | 10/1993 |
| JP | 5-279591 | A | 10/1993 |
| JP | 8-123058 | A | 5/1996 |
| JP | 8-176293 | A | 7/1996 |
| JP | 8-208820 | A | 8/1996 |

(Continued)

*Primary Examiner* — Hoang Ngo
(74) *Attorney, Agent, or Firm* — Sughrue Mion, PLLC

(57) ABSTRACT

An image-forming apparatus includes an electrophotographic photoreceptor including a conductive substrate and a photosensitive layer disposed on the conductive substrate; a charging device that charges a surface of the photoreceptor; an exposure device that forms an electrostatic latent image on the surface of the photoreceptor by irradiating the surface of the photoreceptor with light, the exposure device including plural light sources arranged in an axial direction of the photoreceptor; a developing device including a developer including a toner which forms a toner image by developing the electrostatic latent image with the developer; and a transfer device that transfers the toner image to a recording medium. A mean width WSm of waviness profiles of an outer periphery of the conductive substrate determined in accordance with JIS B0601 (2001) is smaller than an interval at which the light sources are arranged in the axial direction of the photoreceptor.

12 Claims, 3 Drawing Sheets

(56) References Cited

FOREIGN PATENT DOCUMENTS

| | | | |
|---|---|---|---|
| JP | 2004-78147 | A | 3/2004 |
| JP | 2005-181992 | A | 7/2005 |
| JP | 2009-150966 | A | 7/2007 |
| JP | 2009-031342 | A | 2/2009 |
| JP | 2012-155282 | A | 8/2012 |

* cited by examiner

IMAGE-FORMING APPARATUS AND PROCESS CARTRIDGE

CROSS-REFERENCE TO RELATED APPLICATIONS

This application is based on and claims priority under 35 USC 119 from Japanese Patent Application No. 2016-187500 filed Sep. 26, 2016.

BACKGROUND

(i) Technical Field

The present invention relates to an image-forming apparatus and a process cartridge.

(ii) Related Art

When the outer periphery of a conductive substrate is formed by, for example, machining, helical traces of machining may remain on the outer periphery of a conductive substrate. This results in waviness of the outer periphery in the axial direction. When an electrophotographic photoreceptor including such a conductive substrate having an outer periphery having waviness in the axial direction is used as a component of an image-forming apparatus that includes an exposure device including plural light sources, such as a light-emitting diode (LED) printing head, banded inconsistencies in image density may occur.

SUMMARY

According to an aspect of the invention, there is provided an image-forming apparatus including an electrophotographic photoreceptor including a conductive substrate and a photosensitive layer disposed on the conductive substrate; a charging device that charges a surface of the electrophotographic photoreceptor; an exposure device that forms an electrostatic latent image on the charged surface of the electrophotographic photoreceptor by irradiating the charged surface of the electrophotographic photoreceptor with light, the exposure device including plural light sources arranged in an axial direction of the electrophotographic photoreceptor; a developing device including a developer including a toner, the developing device forming a toner image on the surface of the electrophotographic photoreceptor by developing the electrostatic latent image formed on the surface of the electrophotographic photoreceptor with the developer; and a transfer device that transfers the toner image formed on the surface of the electrophotographic photoreceptor onto a surface of a recording medium. A mean width WSm of waviness profiles of an outer periphery of the conductive substrate is smaller than an interval at which the light sources are arranged in the axial direction of the electrophotographic photoreceptor, the mean width WSm being determined in accordance with JIS B0601 (2001).

BRIEF DESCRIPTION OF THE DRAWINGS

Exemplary embodiments of the present invention will be described in detail based on the following figures, wherein.

DETAILED DESCRIPTION

Figure 1:
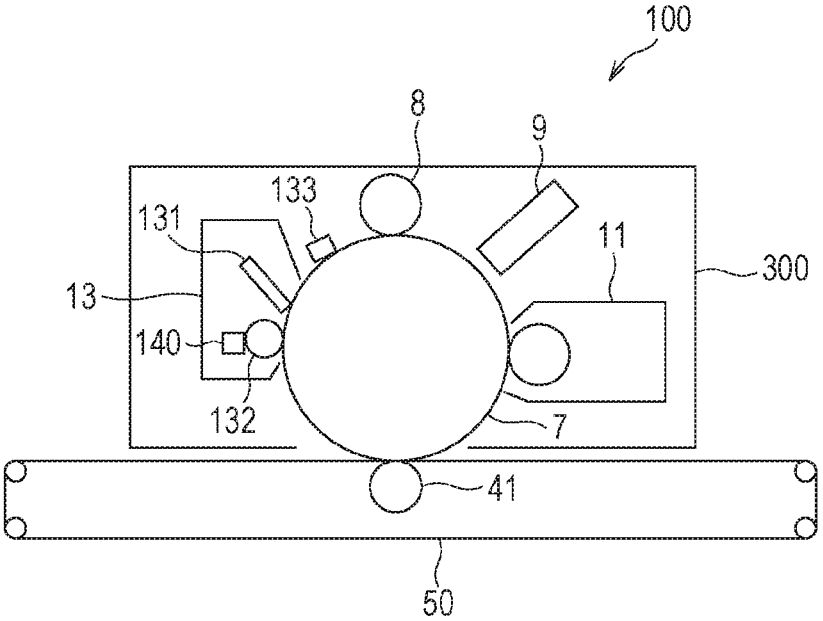
FIG. 1 is a diagram schematically illustrating an example of an image-forming apparatus according to an embodiment.

Exemplary embodiments of the present invention are described below in detail.

Image-Forming Apparatus

An image-forming apparatus according to an exemplary embodiment includes an electrophotographic photoreceptor (hereinafter, referred to simply as "photoreceptor"); a charging device that charges the surface of the photoreceptor; an exposure device that forms an electrostatic latent image on the charged surface of the photoreceptor by irradiating the surface of the photoreceptor with light; a developing device that develops the electrostatic latent image formed on the surface of the photoreceptor with a developer including a toner in order to form a toner image; and a transfer device that transfers the toner image onto the surface of a recording medium.

The photoreceptor includes a conductive substrate and a photosensitive layer disposed on the conductive substrate. The exposure device includes plural light sources arranged in the axial direction of the photoreceptor (hereinafter, referred to simply as "axial direction"). In the image-forming apparatus, the mean width WSm of waviness profiles (i.e., waviness profiles of filtered waves) of an outer periphery of the conductive substrate which is determined in accordance with JIS B0601 (2001) (hereinafter, this mean width WSm is referred to as "mean width of the waviness profile WSm") is smaller than an interval at which the light sources are arranged in the axial direction of the photoreceptor (hereinafter, this interval is referred to as "arrangement interval").

The term "mean width of the waviness profile WSm" used herein refers to the mean width WSm of waviness profiles of the outer periphery of the conductive substrate in the axial direction which is determined in accordance with JIS B0601 (2001). Profile curves of the outer periphery of the conductive substrate in the axial direction are determined by measuring the outer periphery of the conductive substrate from end to end in the axial direction with a surface roughness-profile-shape-measuring machine "SURFCOM 1400" produced by TOKYO SEIMITSU CO., LTD. The mean width WSm of waviness profiles is determined by analyzing the profile curves under the following conditions: evaluation length ln: 8 mm, cutoff value $\lambda c$: 0.8 mm, and cutoff value $\lambda f$: 2.5 μm.

The term "arrangement interval" used herein refers to the average of intervals at which the plural light sources included in the exposure device are arranged in the axial direction of the photoreceptor. Specifically, the distance between the centers (when the light-emitting sections are not point sources, the centers of gravity) of light-emitting sections of each adjacent pair of the light sources arranged in the axial direction of the photoreceptor is considered to be an "interval of the light sources in the axial direction", and the average of the intervals of the light sources in the axial direction is considered to be an "arrangement interval". In the case where the light sources are arranged in plural rows in the axial direction, the interval of the light sources is measured for each row, and the average of the intervals of the respective rows is considered to be the "arrangement interval".

The image-forming apparatus according to this exemplary embodiment, in which the mean width of the waviness profile WSm of the outer periphery of the conductive substrate is smaller than the arrangement interval of the light sources, may reduce the occurrence of banded inconsistencies in image density. The reason for this has not yet been clarified but is presumably as follows.

An example of a method for forming the outer periphery of the conductive substrate is machining in which the outer periphery of the conductive substrate is cut with a machining tool bit or the like from end to end in the axial direction while the conductive substrate is rotated around the axis of the conductive substrate. When the conductive substrate is subjected to such a machining process, helical traces of machining may remain on the outer periphery of the conductive substrate. This results in waviness in the outer periphery of the conductive substrate in the axial direction.

An exposure device including plural light sources arranged in the axial direction of the photoreceptor, such as an LED printing head, may cause the distribution of exposure intensity to fluctuate at regular intervals in the axial direction.

When an electrophotographic photoreceptor including such a conductive substrate having an outer periphery having waviness in the axial direction is used as a component of an image-forming apparatus including such an exposure device including plural light sources arranged in the axial direction, banded inconsistencies in image density may occur due to interference between the variations in exposure intensity and the waviness of the conductive substrate.

In this exemplary embodiment, the mean width of the waviness profile WSm in the axial direction of the conductive substrate is smaller than the arrangement interval of the light sources. Accordingly, the mean width of the waviness profile WSm of the conductive substrate is smaller than the period of the variations in the exposure intensity in the axial direction. This may reduce the likelihood of interference between the variations in exposure intensity and the waviness of the conductive substrate and, as a result, reduce the occurrence of banded inconsistencies in image density.

For the above reasons, the image-forming apparatus according to the exemplary embodiment, in which the mean width of the waviness profile WSm of the outer periphery of the conductive substrate is smaller than the arrangement interval of the light sources, may reduce the occurrence of banded inconsistencies in image density.

The mean width of the waviness profile WSm of the conductive substrate is not limited but smaller than the arrangement interval of the light sources. The mean width of the waviness profile WSm of the conductive substrate is, for example, 0.9 times or less, is preferably 0.51 times or more and 0.9 times or less, and is more preferably 0.7 times or more and 0.8 times or less the arrangement interval of the light sources.

The image-forming apparatus according to this exemplary embodiment may be implemented as any of the following known image-forming apparatuses: an image-forming apparatus that includes a fixing device that fixes a toner image transferred on the surface of a recording medium; a direct-transfer image-forming apparatus that directly transfers a toner image formed on the surface of the electrophotographic photoreceptor onto the surface of a recording medium; an intermediate-transfer image-forming apparatus that transfers a toner image formed on the surface of the electrophotographic photoreceptor onto the surface of an intermediate transfer body (this process is referred to as "first transfer") and further transfers the toner image transferred on the surface of the intermediate transfer body onto the surface of a recording medium (this process is referred to as "second transfer"); an image-forming apparatus that includes a cleaning device that cleans the surface of an electrophotographic photoreceptor which has not yet been charged after a toner image has been transferred; an image-forming apparatus that includes a charge-eliminating device that irradiates, with charge-elimination light, the surface of an electrophotographic photoreceptor which has not yet been charged after a toner image has been transferred in order to eliminate charge; and an image-forming apparatus that includes an electrophotographic-photoreceptor-heating member that heats the electrophotographic photoreceptor in order to lower the relative temperature of the electrophotographic photoreceptor.

In the intermediate-transfer image-forming apparatus, the transfer device includes, for example, an intermediate transfer body onto which a toner image is transferred, a first transfer device that transfers a toner image formed on the surface of the electrophotographic photoreceptor onto the surface of the intermediate transfer body (first transfer), and a second transfer device that transfers the toner image transferred on the surface of the intermediate transfer body onto the surface of a recording medium (second transfer).

The image-forming apparatus according to this exemplary embodiment may be a dry-developing image-forming apparatus or a wet-developing image-forming apparatus, which develops images with a liquid developer.

In the image-forming apparatus according to this exemplary embodiment, for example, a portion including the electrophotographic photoreceptor and the exposure device may have a cartridge structure, that is, may be a process cartridge, which is detachably attachable to the image-forming apparatus. The process cartridge may include, for example, the electrophotographic photoreceptor according to the exemplary embodiment. The process cartridge may further include, for example, at least one component selected from the group constituted by the charging device, the developing device, and the transfer device.

An example of the image-forming apparatus according to this exemplary embodiment is described below. However, the image-forming apparatus is not limited to this. Hereinafter, only the components illustrated in the drawings are described, and the descriptions of the other components are omitted.

FIG. 1 schematically illustrates an example of the image-forming apparatus according to this exemplary embodiment.

As illustrated in FIG. 1, an image-forming apparatus 100 according to this exemplary embodiment includes a process cartridge 300 including an electrophotographic photoreceptor 7, an exposure device 9, a transfer device 41 (i.e., first transfer device), and an intermediate transfer body 50. In the image-forming apparatus 100, the exposure device 9 is arranged inside the process cartridge 300 such that the electrophotographic photoreceptor 7 is exposed to light emitted by the exposure device 9; the transfer device 41 is arranged to face the electrophotographic photoreceptor 7 with the intermediate transfer body 50 interposed therebetween; and the intermediate transfer body 50 is arranged such that part of the intermediate transfer body 50 comes into contact with the electrophotographic photoreceptor 7. The image-forming apparatus 100 also includes a second transfer device (not shown) that transfers a toner image transferred on the intermediate transfer body 50 onto a recording medium such as paper. In the image-forming apparatus 100, the intermediate transfer body 50, the transfer device 41 (i.e., first transfer device), and the second transfer device (not shown) are examples of the transfer device.

The process cartridge 300 illustrated in FIG. 1 includes the electrophotographic photoreceptor 7, a charging device 8, the exposure device 9, a developing device 11, and a cleaning device 13, which are integrally supported inside a housing. The cleaning device 13 includes a cleaning blade 131 (an example of the cleaning member), which is arranged to come into contact with the surface of the electrophotographic photoreceptor 7. The form of the cleaning member is not limited to the cleaning blade 131 and may be, for example, a conductive or insulating fibrous member. The conductive or insulating fibrous member may be used alone or in combination with the cleaning blade 131.

The image-forming apparatus illustrated in FIG. 1 includes a roller-like, fibrous member 132 with which a lubricant 140 is fed onto the surface of the electrophotographic photoreceptor 7 and a flat-brush-like, fibrous member 133 that assists cleaning. However, the image-forming apparatus illustrated in FIG. 1 is merely an example, and the fibrous members 132 and 133 are optional.

The components of the image-forming apparatus according to this exemplary embodiment are each described below.

Electrophotographic Photoreceptor

The photoreceptor 7 includes a conductive substrate and a photosensitive layer disposed on the conductive substrate.

The photosensitive layer may be constituted by a charge-generating layer and a charge-transporting layer that have separate functions (hereinafter, such a photosensitive layer is referred to as "separated-function photosensitive layer") or include only one layer (hereinafter, such a photosensitive layer is referred to as "single-layer photosensitive layer"). When the photosensitive layer is a separated-function photosensitive layer, the charge-generating layer includes a charge-generating material, and the charge-transporting layer includes a charge-transporting material.

The photoreceptor 7 may optionally include layers other than the above-described layers. Examples of the optional layers include an undercoat layer interposed between the conductive substrate and the photosensitive layer and a protection layer disposed on the photosensitive layer.

Specifically, a photoreceptor including a separated-function photosensitive layer may include a conductive substrate, the optional undercoat layer, a charge-generating layer, and a charge-transporting layer that are stacked on top of one another in this order. The charge-generating layer and the charge-transporting layer constitute a separated-function photosensitive layer. A photoreceptor including a single-layer photosensitive layer may include a conductive substrate, the optional undercoat layer, and the single-layer photosensitive layer that are stacked on top of one another in this order.

The layers constituting the photoreceptor 7 are each described below in detail. Hereinafter, the reference numerals of the components are omitted.

Conductive Substrate

Examples of the conductive substrate include a metal sheet, a metal drum, and a metal belt that are made of a metal such as aluminum, copper, zinc, chromium, nickel, molybdenum, vanadium, indium, gold, or platinum or an alloy such as stainless steel. Other examples of the conductive substrate include a paper sheet, a resin film, and a belt on which a conductive compound such as a conductive polymer or indium oxide, a metal such as aluminum, palladium, or gold, or an alloy is deposited by coating, vapor deposition, or lamination. The term "conductive" used herein refers to having a volume resistivity of less than $10^{13}$ Ωcm.

In this exemplary embodiment, as described above, the mean width of the waviness profile WSm in the axial direction of the conductive substrate is smaller than the arrangement interval of the light sources included in the exposure device 9. The mean width of the waviness profile WSm may be 250 μm or more and 750 μm or less, is preferably 300 μm or more and 550 μm or less, and is more preferably 350 μm or more and 450 μm or less.

The arithmetic mean height Wa of the waviness profiles may be, but not limited to, 0.4 μm or less, is preferably 0.1 μm or more and 0.4 μm or less, and is more preferably 0.1 μm or more and 0.2 μm or less. Setting the arithmetic mean height Wa of the waviness profiles to fall within the above range enables the occurrence of banded inconsistencies in image density to be reduced compared with the case where the arithmetic mean height Wa of the waviness profiles exceeds the above range.

A method for controlling the mean width of the waviness profile is not limited and may be selected appropriately depending on the method for producing the conductive substrate and the method for forming the outer periphery of the conductive substrate. Examples of the method for forming the outer periphery of the conductive substrate include machining, etching, anodic oxidation, coarse machining, centerless grinding, sand blasting, and wet honing.

An example method for producing the conductive substrate according to this exemplary embodiment is described below.

First, a base tube made of aluminum, an aluminum alloy, or the like is prepared. The base tube, that is, the tube that has not yet been machined, is formed by hot-extruding aluminum, an aluminum alloy, or the like by a porthole method or a mandrel method and cold-drawing the resulting tube.

The surface of the base tube is machined. A common tool bit made of polycrystalline diamond or the like may be used in this process.

The machining process is performed by rotating the base tube and moving the tool bit brought into contact with the surface of the base tube relative to the base tube in the axial direction of the base tube. In the machining process, both rough machining and finish machining may be performed. Alternatively, only finish machining may be performed. It is possible to control the profile curves of the outer periphery of the conductive substrate by finish machining.

In the case where both rough machining and finish machining are performed in the machining process, one tool bit may be moved between an axial end of the conductive substrate and the other axial end such that rough machining is performed while the tool bit moves from the axial end to the other axial end and finish machining is performed while the tool bit returns from the other axial end to the axial end. Alternatively, two tool bits may be moved from an axial end of the conductive substrate to the other axial end such that both rough machining and finish machining are simultaneously performed while the tool bits move from the axial end to the other axial end.

In the case where the conductive substrate according to the present invention is prepared by machining the surface of the base tube, the mean width of the waviness profile WSm may be controlled by changing, for example, the shape of the tool bit, the machining angle of the tool bit (hereinafter, referred to as "machining angle"), and the amount of feed of the tool bit per revolution of the main shaft.

The amount of feed of the tool bit per revolution of the main shaft is the distance the tool bit is fed in the axial direction while the base tube is rotated one revolution in the axial direction. The larger the amount of feed of the tool bit per revolution of the main shaft, the smaller the amount of time required by machining the outer periphery of the base tube. This increases the productivity but increases the mean width of the waviness profile WSm. The smaller the amount of feed of the tool bit per revolution of the main shaft, the smaller the mean width of the waviness profile WSm.

The conductive substrate may be subjected to a treatment in which an acidic treatment liquid is used or a boehmite treatment.

The treatment in which an acidic treatment liquid is used is performed in, for example, the following manner. An acidic treatment liquid that includes phosphoric acid, chromium acid, and hydrofluoric acid is prepared. The proportions of the amounts of phosphoric acid, chromium acid, and hydrofluoric acid in the acidic treatment liquid may be, for example, 10% by weight or more and 11% by weight or less, 3% by weight or more and 5% by weight or less, and 0.5% by weight or more and 2% by weight or less, respectively. The total concentration of the above acids may be 13.5% by weight or more and 18% by weight or less. The treatment temperature may be, for example, 42° C. or more and 48° C. or less. The thickness of the resulting coating film may be 0.3 μm or more and 15 μm or less.

In the boehmite treatment, for example, the conductive substrate is immersed in pure water having a temperature of 90° C. or more and 100° C. or less for 5 to 60 minutes or brought into contact with steam having a temperature of 90° C. or more and 120° C. or less for 5 to 60 minutes. The thickness of the resulting coating film may be 0.1 μm or more and 5 μm or less. The coating film may optionally be subjected to an anodic oxidation treatment with an electrolyte solution in which the coating film is hardly soluble, such as adipic acid, boric acid, a boric acid salt, a phosphoric acid salt, a phthalic acid salt, a maleic acid salt, a benzoic acid salt, a tartaric acid salt, or a citric acid salt.

Undercoat Layer

The undercoat layer includes, for example, inorganic particles and a binder resin.

The inorganic particles may have, for example, a powder resistivity (i.e., volume resistivity) of $10^2$ Ωcm or more and $10^{11}$ Ωcm or less.

Among such inorganic particles having the above resistivity, for example, metal oxide particles such as tin oxide particles, titanium oxide particles, zinc oxide particles, and zirconium oxide particles are preferable and zinc oxide particles are particularly preferable.

The BET specific surface area of the inorganic particles may be, for example, 10 $m^2/g$ or more.

The volume-average diameter of the inorganic particles may be, for example, 50 nm or more and 2,000 nm or less and is preferably 60 nm or more and 1,000 nm or less.

The content of the inorganic particles is preferably, for example, 10% by weight or more and 80% by weight or less and is more preferably 40% by weight or more and 80% by weight or less of the amount of binder resin.

The inorganic particles may optionally be subjected to a surface treatment. It is possible to use two or more types of inorganic particles which have been subjected to different surface treatments or have different diameters in a mixture.

Examples of an agent used in the surface treatment include a silane coupling agent, a titanate coupling agent, an aluminum coupling agent, and a surfactant. In particular, a silane coupling agent is preferable, and a silane coupling agent including an amino group is more preferable.

Examples of the silane coupling agent including an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-(2-aminoethylamino)propyltriethoxysilane.

Two or more silane coupling agents may be used in a mixture. For example, a silane coupling agent including an amino group may be used in combination with another type of silane coupling agent. Examples of the other type of silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

A method for treating the surface of the inorganic particles with the surface-treating agent is not limited, and any known surface treatment method may be employed. Both dry process and wet process may be employed.

The amount of surface-treating agent used may be, for example, 0.5% by weight or more and 10% by weight or less of the amount of inorganic particles.

The undercoat layer may include an electron-accepting compound (i.e., acceptor compound) in addition to the inorganic particles in order to enhance the long-term stability of electrical properties and carrier-blocking property.

Examples of the electron-accepting compound include the following electron-transporting substances: quinones such as chloranil and bromanil; tetracyanoquinodimethanes; fluorenones such as 2,4,7-trinitrofluorenone and 2,4,5,7-tetranitro-9-fluorenone; oxadiazoles such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthones; thiophenes; and diphenoquinones such as 3,3',5,5'-tetra-t-butyldiphenoquinone.

In particular, compounds including an anthraquinone structure may be used as an electron-accepting compound. Examples of the compounds including an anthraquinone structure include hydroxyanthraquinones, aminoanthraquinones, and aminohydroxyanthraquinones. Specific examples thereof include anthraquinone, alizarin, quinizarin, anthrarufin, and purpurin.

The electron-accepting compound included in the undercoat layer may be dispersed in the undercoat layer together with the inorganic particles or deposited on the surfaces of the inorganic particles.

For depositing the electron-accepting compound on the surfaces of the inorganic particles, for example, a dry process or a wet process may be employed.

In a dry process, for example, while the inorganic particles are stirred with a mixer or the like capable of producing a large shearing force, the electron-accepting compound or a solution prepared by dissolving the electron-accepting compound in an organic solvent is added dropwise or sprayed together with dry air or a nitrogen gas to the inorganic particles in order to deposit the electron-accepting compound on the surfaces of the inorganic particles. The addition or spraying of the electron-accepting compound may be done at a temperature equal to or lower than the boiling point of the solvent used. Subsequent to the addition or spraying of the electron-accepting compound, the resulting inorganic particles may optionally be baked at 100° C. or more. The temperature at which the inorganic particles are baked and the amount of time during which the inorganic particles are baked are not limited; the inorganic particles may be baked under appropriate conditions of temperature and time under which the intended electrophotographic properties are achieved.

In a wet process, for example, while the inorganic particles are dispersed in a solvent with a stirrer, an ultrasonic wave, a sand mill, an Attritor, a ball mill, or the like, the electron-accepting compound is added to the dispersion liquid. After the resulting mixture has been stirred or dispersed, the solvent is removed such that the electron-accepting compound is deposited on the surfaces of the inorganic particles. The removal of the solvent may be done by, for example, filtration or distillation. Subsequent to the removal of the solvent, the resulting inorganic particles may optionally be baked at 100° C. or more. The temperature at which the inorganic particles are baked and the amount of time during which the inorganic particles are baked are not limited; the inorganic particles may be baked under appropriate conditions of temperature and time under which the intended electrophotographic properties are achieved. In the wet process, moisture contained in the inorganic particles may be removed prior to the addition of the electron-accepting compound. The removal of moisture contained in the inorganic particles may be done by, for example, heating the inorganic particles while being stirred in the solvent or by bringing the moisture to the boil together with the solvent.

The deposition of the electron-accepting compound may be done prior or subsequent to the surface treatment of the inorganic particles with the surface-treating agent. Alternatively, the deposition of the electron-accepting compound and the surface treatment using the surface-treating agent may be performed at the same time.

The content of the electron-accepting compound may be, for example, 0.01% by weight or more and 20% by weight or less and is preferably 0.01% by weight or more and 10% by weight or less of the amount of inorganic particles.

Examples of the binder resin included in the undercoat layer include the following known materials: known high-molecular compounds such as an acetal resin (e.g., polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenolic resin, a phenol-formaldehyde resin, a melamine resin, a urethane resin, an alkyd resin, and an epoxy resin; zirconium chelates; titanium chelates; aluminum chelates; titanium alkoxides; organic titanium compounds; and silane coupling agents.

Other examples of the binder resin included in the undercoat layer include charge-transporting resins including a charge-transporting group and conductive resins such as polyaniline.

Among the above binder resins, a resin insoluble in a solvent included in a coating liquid used for forming a layer on the undercoat layer may be used as a binder resin included in the undercoat layer. In particular, resins produced by reacting at least one resin selected from the group constituted by thermosetting resins (e.g., a urea resin, a phenolic resin, a phenol-formaldehyde resin, a melamine resin, a urethane resin, an unsaturated polyester resin, an alkyd resin, and an epoxy resin), polyamide resins, polyester resins, polyether resins, methacrylic resins, acrylic resins, polyvinyl alcohol resins, and polyvinyl acetal resins with a curing agent may be used.

In the case where two or more types of the above binder resins are used in combination, the mixing ratio between the binder resins may be set appropriately.

The undercoat layer may include various additives in order to enhance electrical properties, environmental stability, and image quality.

Examples of the additives include the following known materials: electron-transporting pigments such as polycondensed pigments and azo pigments, zirconium chelates, titanium chelates, aluminum chelates, titanium alkoxides, organic titanium compounds, and silane coupling agents. The silane coupling agents, which are used in the surface treatment of the inorganic particles as described above, may also be added to the undercoat layer as an additive.

Examples of silane coupling agents that may be used as an additive include vinyltrimethoxysilane, 3-methacryloxypropyl-tris(2-methoxyethoxy)silane, 2-(3,4-epoxycyclohexyl) ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelates include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelates include tetraisopropyl titanate, tetra-n-butyl titanate, butyl titanate dimer, tetra-(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolamine, and polyhydroxy titanium stearate.

Examples of the aluminum chelates include aluminum isopropylate, monobutoxy aluminum diisopropylate, aluminum butyrate, diethyl acetoacetate aluminum diisopropylate, and aluminum tris(ethyl acetoacetate).

The above additives may be used alone. Alternatively, two or more types of the above additives may be used in a mixture or in the form of a polycondensate.

The undercoat layer may have a Vickers hardness of 35 or more.

In order to reduce the formation of moiré fringes, the surface roughness (i.e., ten-point-average roughness) of the undercoat layer may be adjusted to $1/(4n)$ to ½ of the wavelength $\lambda$ of the laser beam used as exposure light, where n is the refractive index of the layer that is to be formed on the undercoat layer.

Resin particles and the like may be added to the undercoat layer in order to adjust the surface roughness of the undercoat layer. Examples of the resin particles include silicone resin particles and crosslinked polymethyl methacrylate resin particles. The surface of the undercoat layer may be polished in order to adjust the surface roughness of the undercoat layer. For polishing the surface of the undercoat layer, buffing, sand blasting, wet honing, grinding, and the like may be performed.

A method for forming the undercoat layer is not limited, and known methods may be employed. For example, a coating film is formed using a coating liquid (hereinafter, referred to as "undercoat-layer-forming coating liquid")

prepared by mixing the above-described components with a solvent, and the coating film is dried and, as needed, heated.

Examples of the solvent used for preparing the undercoat-layer-forming coating liquid include known organic solvents such as an alcohol solvent, an aromatic hydrocarbon solvent, a halogenated hydrocarbon solvent, a ketone solvent, a ketone alcohol solvent, an ether solvent, and an ester solvent.

Specific examples thereof include the following common organic solvents: methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

For dispersing the inorganic particles in the preparation of the undercoat-layer-forming coating liquid, for example, known equipment such as a roll mill, a ball mill, a vibrating ball mill, an Attritor, a sand mill, a colloid mill, and a paint shaker may be used.

For coating the conductive substrate with the undercoat-layer-forming coating liquid, for example, common methods such as blade coating, wire bar coating, spray coating, dip coating, bead coating, air knife coating, and curtain coating may be employed.

The thickness of the undercoat layer is preferably, for example, 15 μm or more and is more preferably 20 μm or more and 50 μm or less.

Intermediate Layer

An intermediate layer may optionally be interposed between the undercoat layer and the photosensitive layer.

The intermediate layer includes, for example, a resin. Examples of the resin included in the intermediate layer include the following high-molecular compounds: acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may include an organometallic compound. Examples of the organometallic compound included in the intermediate layer include organometallic compounds containing a metal atom such as a zirconium atom, a titanium atom, an aluminum atom, a manganese atom, or a silicon atom.

The above compounds included in the intermediate layer may be used alone. Alternatively, two or more types of the above compounds may be used in a mixture or in the form of a polycondensate.

In particular, the intermediate layer may include an organometallic compound containing a zirconium atom or a silicon atom.

A method for forming the intermediate layer is not limited, and known methods may be employed. For example, a coating film is formed using an intermediate-layer-forming coating liquid prepared by mixing the above-described components with a solvent, and the coating film is dried and, as needed, heated.

For forming the intermediate layer, common coating methods such as dip coating, push coating, wire bar coating, spray coating, blade coating, knife coating, and curtain coating may be employed.

The thickness of the intermediate layer may be, for example, 0.1 μm or more and 3 μm or less. It is possible to use the intermediate layer also as an undercoat layer.

Charge-Generating Layer

The charge-generating layer includes, for example, a charge-generating material and a binder resin. The charge-generating layer may be formed by the vapor deposition of the charge-generating material. A charge-generating layer formed by the vapor deposition of a charge-generating material may be used particularly in the case where an incoherent light source such as a light-emitting diode (LED) or an organic electroluminescence (EL) image array is used.

Examples of the charge-generating material include azo pigments such as bisazo and trisazo; annulated aromatic pigments such as dibromoanthanthrone; perylene pigments; pyrrolopyrrole pigments; phthalocyanine pigments; zinc oxide; and trigonal selenium.

Among the above charge-generating materials, in particular, a metal phthalocyanine pigment or a nonmetal phthalocyanine pigment may be used in consideration of exposure to a laser beam in the near-infrared region. Specific examples of such charge-generating materials include hydroxygallium phthalocyanine, chlorogallium phthalocyanine, dichlorotin phthalocyanine, and titanyl phthalocyanine.

Among the above-charge-generating materials, annulated aromatic pigments such as dibromoanthanthrone; thioindigo pigments; porphyrazines; zinc oxide; trigonal selenium; and bisazo pigments may be used in consideration of exposure to a laser beam in the near-ultraviolet region.

The above charge-generating materials may be used also in the case where an incoherent light source such as an LED or an organic EL image array, which emits light having a center wavelength of 450 nm or more and 780 nm or less, is used. However, when the thickness of the photosensitive layer is reduced to 20 μm or less in order to increase the resolution, the strength of the electric field in the photosensitive layer may be increased. This increases the occurrence of a reduction in the amount of charge generated due to the injection of charge from the substrate, that is, image defects referred to as "black spots". This becomes more pronounced when a p-type semiconductor that is likely to induce a dark current, such as trigonal selenium or a phthalocyanine pigment, is used as a charge-generating material.

In contrast, in the case where an n-type semiconductor such as an annulated aromatic pigment, a perylene pigment, or an azo pigment is used as a charge-generating material, the dark current is hardly induced and the occurrence of the image defects referred to as "black spots", may be reduced even when the thickness of the photosensitive layer is reduced.

Whether or not a charge-generating material is n-type is determined on the basis of the polarity of the photoelectric current that flows in the charge-generating material by a commonly used time-of-flight method. Specifically, a charge-generating material in which electrons are more easily transmitted as carriers than holes is determined to be n-type.

The binder resin included in the charge-generating layer is selected from various insulating resins. The binder resin may also be selected from organic photoconductive polymers such as poly-N-vinylcarbazole, polyvinyl anthracene, polyvinylpyrene, and polysilane.

Specific examples of the binder resin include a polyvinyl butyral resin, a polyarylate resin (e.g., polycondensate of a bisphenol and an aromatic dicarboxylic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, and a polyvinylpyrrolidone resin. The term "insulating" used herein refers to having a volume resistivity of $10^{13}$ Ωcm or more.

The above binder resins may be used alone or in a mixture of two or more.

The ratio of the amount of charge-generating material to the amount of binder resin may be 10:1 to 1:10 by weight.

The charge-generating layer may optionally include known additives.

A method for forming the charge-generating layer is not limited, and any known method may be employed. For example, the above components are dissolved in a solvent in order to form a coating liquid used for forming the charge-generating layer (hereinafter, referred to as "charge-generating-layer-forming coating liquid"). The charge-generating-layer-forming coating liquid is formed into a coating film, which is dried and, as needed, subsequently heated. Alternatively, the charge-generating layer may be formed by the vapor deposition of the charge-generating material. The charge-generating layer may be formed by the vapor deposition particularly when the charge-generating material is an annulated aromatic pigment or a perylene pigment.

Examples of the solvent used for preparing the charge-generating-layer-forming coating liquid include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. The above solvents may be used alone or in a mixture of two or more.

For dispersing particles of the charge-generating material or the like in the charge-generating-layer-forming coating liquid, for example, media dispersing machines such as a ball mill, a vibrating ball mill, an Attritor, a sand mill, and a horizontal sand mill; and medialess dispersing machines such as a stirrer, an ultrasonic wave disperser, a roll mill, and a high-pressure homogenizer may be used. Specific examples of the high-pressure homogenizer include an impact-type homogenizer in which a dispersion is brought into collision with a liquid or a wall under a high-pressure condition in order to perform dispersion; and a through-type homogenizer in which a dispersion is passed through a very thin channel under a high-pressure condition in order to perform dispersion.

The average diameter of the particles of the charge-generating material dispersed in the charge-generating-layer-forming coating liquid may be 0.5 μm or less, is preferably 0.3 μm or less, and is further preferably 0.15 μm or less.

For applying the charge-generating-layer-forming coating liquid to the undercoat layer (or, the intermediate layer), for example, common coating methods such as blade coating, wire bar coating, spray coating, dip coating, bead coating, air knife coating, and curtain coating may be employed.

The thickness of the charge-generating layer is, for example, preferably 0.1 μm or more and 5.0 μm or less and is more preferably 0.2 μm or more and 2.0 μm or less.

Charge-Transporting Layer

The charge-transporting layer includes, for example, a charge-transporting material and a binder resin. The charge-transporting layer may include a polymeric charge-transporting material.

Examples of the charge-transporting material include, but are not limited to, the following electron-transporting compounds: quinones such as p-benzoquinone, chloranil, bromanil, and anthraquinone; tetracyanoquinodimethane compounds; fluorenones such as 2,4,7-trinitrofluorenone; xanthones; benzophenones; cyanovinyl compounds; and ethylenes. Examples of the charge-transporting material further include hole-transporting compounds such as triarylamines, benzidines, arylalkanes, aryl-substituted ethylenes, stilbenes, anthracenes, and hydrazones. The above charge-transporting materials may be used alone or in combination of two or more.

In particular, the triarylamine derivative represented by Structural Formula (a-1) below or the benzidine derivative represented by Structural Formula (a-2) below may be used as a charge-transporting material in consideration of the mobility of charge.

(a-1)

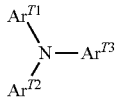

In Structural Formula (a-1), $Ar^{T1}$, $Ar^{T2}$, and $Ar^{T3}$ each independently represent an aryl group, a substituted aryl group, a $—C_6H_4—C(R^{T4})═C(R^{T5})(R^{T6})$ group, or a $—C_6H_4—CH═CH—CH═C(R^{T7})(R^{T8})$ group, where $R^{T4}$, $R^{T5}$, $R^{T6}$, $R^{T7}$, and $R^{T8}$ each independently represent a hydrogen atom, an alkyl group, a substituted alkyl group, an aryl group, or a substituted aryl group.

Examples of a substituent included in the above substituted groups include a halogen atom, an alkyl group having from 1 to 5 carbon atoms, an alkoxy group having from 1 to 5 carbon atoms, and an amino group substituted with an alkyl group having from 1 to 3 carbon atoms.

(a-2)

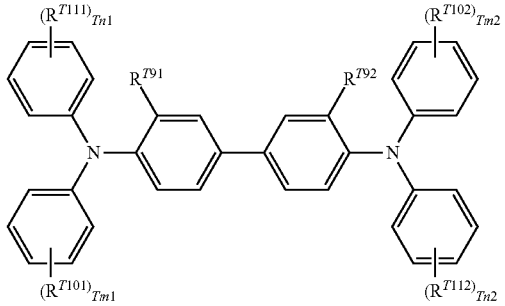

In Structural Formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms; $R^{T101}$, $R^{T102}$, $R^{T111}$, and $R^{T112}$ each independently represent a halogen atom, an alkyl group having from 1 to 5 carbon atoms, an alkoxy group having from 1 to 5 carbon atoms, an amino group substituted with an alkyl group having from 1 or 2 carbon atoms, an aryl group, a substituted aryl group, a $—C(R^{T12})═C(R^{T13})(R^{T14})$ group, or a $—CH═CH—CH═C(R^{T15})(R^{T16})$ group, where $R^{T12}$, $R^{T13}$, $R^{T14}$, $R^{T15}$, and $R^{T16}$ each independently represent a hydrogen atom, an alkyl group, a substituted alkyl group, an aryl group, or a substituted aryl group; and Tm1, Tm2, Tn1, and Tn2 each independently represent an integer of from 0 to 2.

Examples of a substituent included in the above substituted groups include a halogen atom, an alkyl group having from 1 to 5 carbon atoms, an alkoxy group having from 1 to 5 carbon atoms, and an amino group substituted with an alkyl group having from 1 to 3 carbon atoms.

Among triarylamine derivatives represented by Structural Formula (a-1) above and benzidine derivatives represented by Structural Formula (a-2) above, in particular, a triarylamine derivative that includes the $—C_6H_4—CH═CH—CH═C(R^{T7})(R^{T8})$ group and a benzidine derivative that includes the $—CH═CH—CH═C(R^{T15})(R^{T16})$ group may be used in consideration of the mobility of charge.

The polymeric charge-transporting material may be any known charge-transporting compound such as poly-N-vinylcarbazole or polysilane. In particular, a polyester-based polymeric charge-transporting material may be used. The above polymeric charge-transporting materials may be used alone or in combination with the above binder resins.

Examples of the binder resin included in the charge-transporting layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. Among the above binder resins, in particular, a polycarbonate resin and a polyarylate resin may be used. The above binder resins may be used alone or in combination of two or more.

The ratio of the amount of charge-transporting material to the amount of binder resin may be from 10:1 to 1:5 by weight.

The charge-transporting layer may optionally include known additives.

A method for forming the charge-transporting layer is not limited, and any known method may be employed. For example, the above components are dissolved in a solvent in order to form a coating liquid used for forming the charge-transporting layer (hereinafter, referred to as "charge-transporting-layer-forming coating liquid"). The charge-transporting-layer-forming coating liquid is formed into a coating film, which is dried and, as needed, subsequently heated.

Examples of the solvent used for preparing the charge-transporting-layer-forming coating liquid include the following common organic solvents: aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic and linear ethers such as tetrahydrofuran and ethyl ether. The above solvents may be used alone or in a mixture of two or more.

For applying the charge-transporting-layer-forming coating liquid onto the surface of the charge-generating layer, for example, the following common coating methods may be used: blade coating, wire bar coating, spray coating, dip coating, bead coating, air knife coating, and curtain coating.

The thickness of the charge-transporting layer is, for example, preferably 5 μm or more and 50 μm or less and is more preferably 10 μm or more and 30 μm or less.

Protection Layer

A protection layer may optionally be disposed on the photosensitive layer. The protection layer is provided in order to, for example, reduce the chemical change of the photosensitive layer which may occur during charging and increase the mechanical strength of the photosensitive layer.

Therefore, the protection layer may be a layer composed of a cured film (i.e., crosslinked film). Examples of such a layer include the layers described in 1) and 2) below.

1) A layer composed of a film formed by curing a composition including a reactive-group-containing, charge transporting material, which includes a reactive group and a charge transporting skeleton in the same molecule, that is, a layer including a polymer or a crosslinked product of the reactive-group-containing, charge transporting material.

2) A layer composed of a film formed by curing a composition including a nonreactive, charge transporting material and a reactive-group-containing, non-charge-transporting material, which does not include a charge transporting skeleton and includes a reactive group, that is, a layer including a polymer or a crosslinked product of the nonreactive, charge transporting material with the reactive-group-containing, non-charge-transporting material.

Examples of the reactive group included in the reactive-group-containing, charge transporting material include the following known reactive groups: a chain-polymerization group; an epoxy group; a —OH group; a —OR group, where R is an alkyl group; a $—NH_2$ group; a —SH group; a —COOH group; and a $—SiR^{Q1}_{3-Qn}(OR^{Q2})_{Qn}$ group, where $R^{Q1}$ represents a hydrogen atom, an alkyl group, or an unsubstituted or substituted aryl group, $R^{Q2}$ represents a hydrogen atom, an alkyl group, or a trialkylsilyl group, and Qn is an integer of 1 to 3.

The type of the chain-polymerization group is not limited, and any functional group capable of inducing radical polymerization may be used. Examples of such a functional group include functional groups including at least a carbon double bond. Specific examples of the functional groups include functional groups including at least one selected from a vinyl group, a vinylether group, a vinylthioether group, a vinylphenyl group, an acryloyl group, a methacryloyl group, and derivatives of the above groups. In particular, a chain-polymerization group including at least one selected from a vinyl group, a vinylphenyl group, an acryloyl group, a methacryloyl group, and derivatives of the above groups may be used, because such a chain-polymerization group has high reactivity.

The charge transporting skeleton included in the reactive-group-containing, charge transporting material is not limited, and any charge transporting skeleton having a known structure commonly used in electrophotographic photosensitive members may be used. Examples of such a charge transporting skeleton include skeletons that are derived from nitrogen-containing, hole transporting compounds such as triarylamines, benzidines, and hydrazones and conjugated with a nitrogen atom. Among the above skeletons, in particular, a triarylamine skeleton may be used.

The above-described reactive-group-containing, charge transporting material including a reactive group and a charge transporting skeleton, nonreactive, charge transporting material, and reactive-group-containing, non-charge-transporting material may be selected from common materials.

The protection layer may optionally include other known additives.

The method for forming the protection layer is not limited, and known formation methods may be used. For example, a coating film is formed using a protection-layer-forming coating liquid prepared by mixing the above-described components in a solvent, subsequently dried, and, as needed, caused to cure by, for example, being heated.

Examples of the solvent used for preparing the protection-layer-forming coating liquid include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvent such as isopropyl alcohol and butanol. The above solvents may be used alone or in a mixture of two or more.

The protection-layer-forming coating liquid may be prepared without using a solvent.

For applying the protection-layer-forming coating liquid on the photosensitive layer (e.g., the charge-transporting layer), the following common methods may be employed: dip coating, push coating, wire bar coating, spray coating, blade coating, knife coating, curtain coating, and the like.

The thickness of the protection layer is preferably, for example, 1 μm or more and 20 μm or less and is more preferably 2 μm or more and 10 μm or less.

Single-Layer Photosensitive Layer

A single-layer photosensitive layer (i.e., a charge-generating and transporting layer) includes, for example, a charge-generating material, a charge-transporting material, and, as needed, a binder resin and known additives. These materials are the same as those described in Charge-Generating Layer and Charge-Transporting Layer above.

The amount of charge-generating material may be 10% by weight or more and 85% by weight or less and is preferably 20% by weight or more and 50% by weight or less of the total solid content of the single-layer photosensitive layer. The amount of charge-transporting material may be 5% by weight or more and 50% by weight or less of the total solid content of the single-layer photosensitive layer.

The single-layer photosensitive layer may be formed by the same method as the charge-generating layer and the charge-transporting layer.

The thickness of the single-layer photosensitive layer may be, for example, 5 μm or more and 50 μm or less and is preferably 10 μm or more and 40 μm or less.

Charging Device

Examples of the charging device 8 include contact chargers that include, for example, a charging roller, a charging brush, a charging film, a charging rubber blade, or a charging tube that are conductive or semiconductive; contactless roller chargers; and known chargers such as a scorotron charger and a corotron charger that utilize corona discharge.

Exposure Device

The exposure device 9 may be, for example, an optical device with which the outer periphery of the photoreceptor 7 can be exposed to light emitted by a semiconductor laser, an LED, a liquid-crystal shutter, or the like in a predetermined image pattern. The wavelength of the light source is set to fall within the range of the spectral sensitivity of the photoreceptor. Although common semiconductor lasers have an oscillation wavelength in the vicinity of 780 nm, that is, the near-infrared region, the wavelength of the light source is not limited to this; semiconductor lasers having an oscillation wavelength of about 600 to 700 nm and blue semiconductor lasers having an oscillation wavelength of 400 nm or more and 450 nm or less may also be used. For forming color images, surface-emitting lasers capable of emitting multi beam may be used as a light source.

As described above, the exposure device 9 includes plural light sources arranged in the axial direction of the photoreceptor 7.

The arrangement interval of the light sources may be, but not limited to, 400 μm or more and 800 μm or less, is preferably 400 μm or more and 600 μm or less, and is more preferably 400 μm or more and 500 μm or less.

The light sources included in the exposure device 9 may be, but are not limited to, incoherent exposure light sources.

Incoherent exposure light sources are light sources that emit incoherent light. Examples of the incoherent exposure light sources include light-emitting diodes (LED) and an organic electroluminescence (EL) imaging array.

The area of a portion of the surface of the electrophotographic photoreceptor which is exposed to light emitted by the incoherent exposure light sources is 1000 $\mu m^2$ or less. The center wavelength of light emitted from the incoherent exposure light sources may be 450 nm or more and 780 nm or less.

An example of the exposure device is described below.

Figure 2:
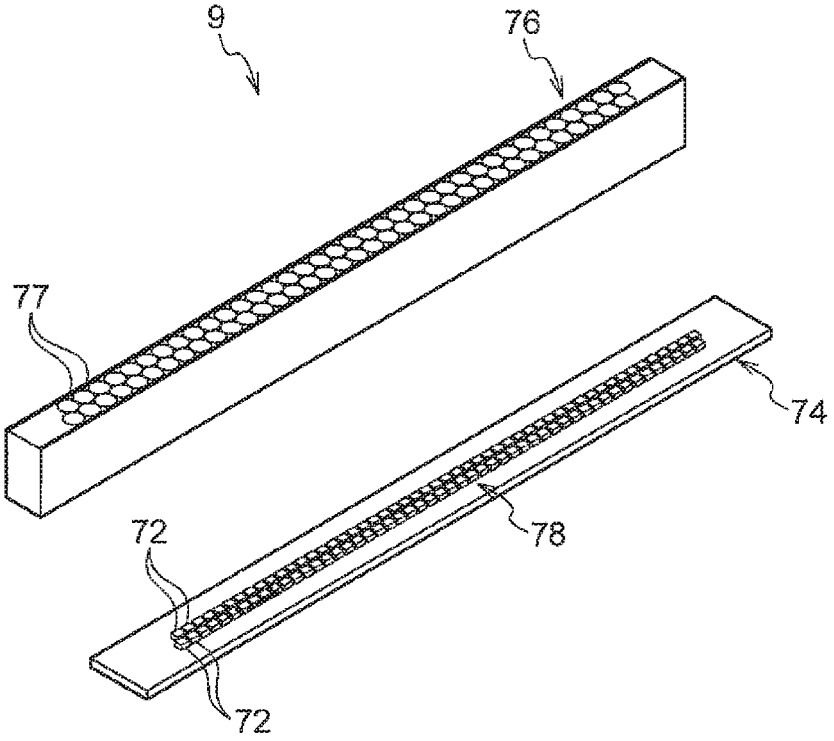
FIG. 2 is a diagram schematically illustrating an example of an exposure device.

FIG. 2 illustrates an example of the exposure device. The exposure device illustrated in FIG. 2 includes, for example, a light-emitting element array 78 including light-emitting elements 72 and an imaging section 76 including lenses 77.

The light-emitting element array 78 includes, for example, a light-emitting section including the light-emitting elements 72 such as organic EL elements and a light-emitting element array substrate 74 that is a mount substrate on which the light-emitting elements 72 are disposed.

The light-emitting element array 78 and the imaging section 76 are held by a holding member so as to be separated from each other such that the optical distance between the light-emitting section including the light-emitting elements 72 and the light-receiving surface of the imaging section 76 is equal to the operating distance of the imaging section 76.

The operating distance of the imaging section 76 is the distance between the focal point of the lenses 77 included in the imaging section 76 and the light-receiving surface of the imaging section 76.

The term "light-receiving surface" of the imaging section 76 refers to the surface of the imaging section 76 which is closer to the light-emitting element array 78. The term "light-emitting surface" of the imaging section 76 refers to the other surface of the imaging section 76 which is farther from the light-emitting element array 78, that is, closer to the photoreceptor 7.

The imaging section 76 receives light emitted from the light-emitting section including the light-emitting elements 72 on the light-receiving surface and emits the light from the light-emitting surface such that an image is formed at a predetermined position. Thus, an image is formed on the photoreceptor 7 with light emitted by the light-emitting elements 72. That is, the photoreceptor 7 is exposed to light, and a latent image is formed on the photoreceptor 7.

The light-emitting element array 78 is described below.

The light-emitting element array 78 operates in a "bottom-emission" mode in which light emitted from the light-emitting section is extracted on the side on which the light-emitting element array substrate 74, that is, the mount substrate, is located. The light-emitting element array 78 may alternatively operate in a "top-emission" mode.

The light-emitting section may be constituted by a group of single type of light-emitting elements 72. The light-emitting elements 72 are arranged on the mount substrate, that is, the light-emitting element array substrate 74, in the longitudinal direction in a linear pattern (i.e., in series) or in a hounds-tooth pattern to form the light-emitting section. The light-emitting section constituted by the group of light-emitting elements 72 is longer than an image-formation region in the axial direction of the photoreceptor 7.

The imaging section 76 is described below.

The imaging section 76 may include a lens array constituted by plural rod lens. A specific example of such a lens array is a distributed-refractive-index lens array "SELFOC lens array" (SLA, "SELFOC" is a registered trademark of Nippon Sheet Glass Company, Ltd.). Optionally, a cylindrical lens may be used in combination. A microlens may be joined to each organic EL element used as a light source.

Developing Device

The developing device 11 may be, for example, a common developing device that develops latent images with a developer in a contacting or noncontacting manner. The type of the developing device 11 is not limited and may be selected from those having the above functions depending on the purpose. Examples of such a developing device include known developing devices capable of depositing a one- or two-component developer on the electrophotographic photoreceptor 7 with a brush, a roller, or the like. In particular, a developing device including a developing roller on which a developer is deposited may be used.

The developer included in the developing device 11 may be a one-component developer including only a toner or a two-component developer including a toner and a carrier. The developer may be magnetic or nonmagnetic. Known developers may be used as a developer included in the developing device 11.

Cleaning Device

The cleaning device 13 may be, for example, a cleaning-blade-type cleaning device including a cleaning blade 131.

The type of the cleaning device 13 is not limited to the cleaning-blade-type cleaning device, and a fur-brush-cleaning-type cleaning device may also be used. In another case, cleaning and development may be performed at the same time.

Transfer Device

The transfer device 41 may be, for example, any of the following known transfer chargers: contact transfer chargers including a belt, a roller, a film, a rubber blade, or the like; and transfer chargers which utilize corona discharge, such as a scorotron and a corotron.

Intermediate Transfer Body

The intermediate transfer body 50 may be, for example, a belt-like intermediate transfer body, that is, an intermediate transfer belt, including polyimide, polyamideimide, polycarbonate, polyarylate, polyester, a rubber, or the like that is made semiconductive. The intermediate transfer body is not limited to a belt-like intermediate transfer body and may be a drum-like intermediate transfer body.

Figure 3:
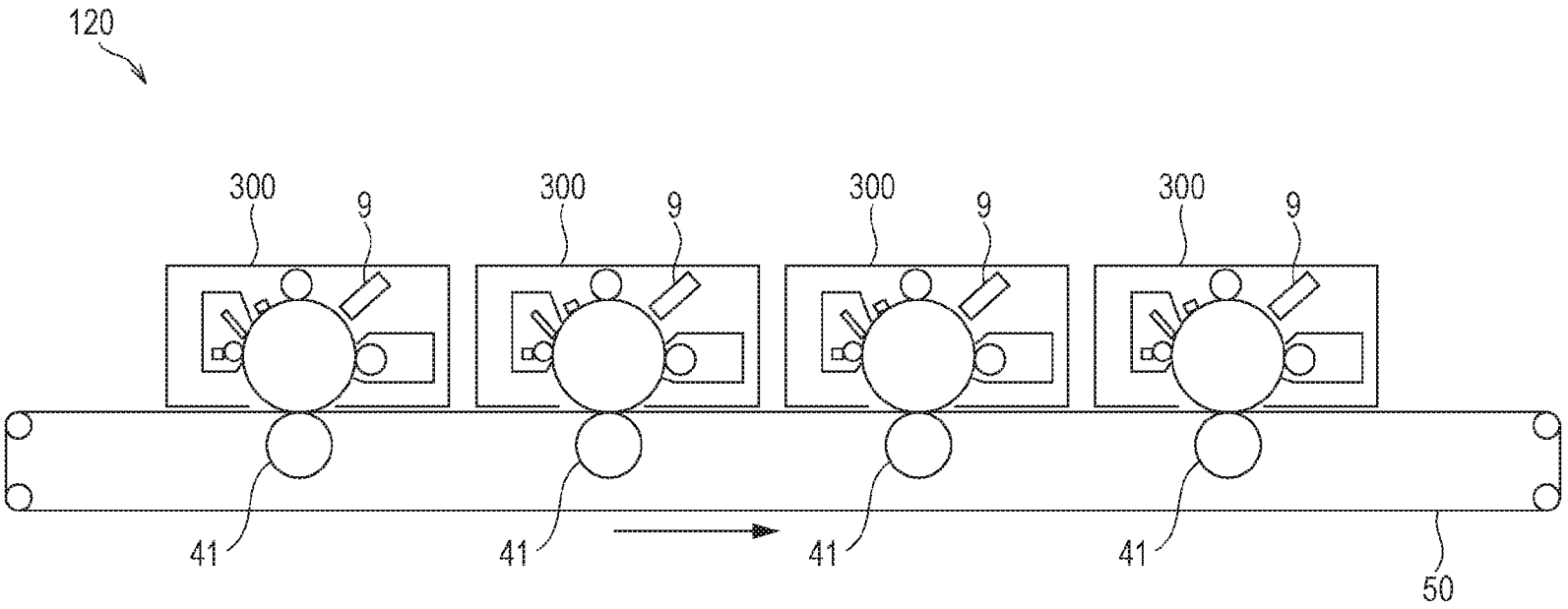
FIG. 3 is a diagram schematically illustrating another example of an image-forming apparatus according to an embodiment.

FIG. 3 schematically illustrates another example of the image-forming apparatus according to this exemplary embodiment.

An image-forming apparatus 120 illustrated in FIG. 3 is a tandem, multi-color image-forming apparatus including four process cartridges 300. In the image-forming apparatus 120, the four process cartridges 300 are arranged in parallel to one another on an intermediate transfer body 50, and one electrophotographic photoreceptor is used for one color. The image-forming apparatus 120 has the same structure as the image-forming apparatus 100 except that the image-forming apparatus 120 is tandem.

Image-Forming Operation (Image-Forming Method)

An operation (i.e., a method) for forming an image using the image-forming apparatus 100 is described below.

First, the surface of the photoreceptor 7 is charged with the charging device 8 (charging step). The exposure device 9 irradiates the charged surface of the photoreceptor 7 with light on the basis of image information. Thus, an electrostatic latent image based on the image information is formed on the photoreceptor 7 (electrostatic latent image-forming step). The developing device 11, which includes a developer including a toner, develops the electrostatic latent image formed on the surface of the photoreceptor 7 with the developer. As a result, a toner image is formed on the surface of the photoreceptor 7 (developing step). The transfer device 41 transfers the toner image formed on the surface of the photoreceptor 7 to a recording medium (transfer step). The toner image transferred on the recording medium is fixed to the recording medium with, for example, a fixing device (not shown).

The surface of the photoreceptor 7 from which the toner image has been transferred is cleaned with the cleaning device 13.

Examples

The above-described exemplary embodiments are described in detail with reference to Examples below. The above-described exemplary embodiments are not limited by Examples below. In the following description, "part" and "%" are all on a weight basis unless otherwise specified.

Preparation of Photoreceptor 1

Preparation of Conductive Substrate

A tubular material is formed by hot porthole extrusion and subsequently cold-drawn in order to increase the accuracy of dimensions. Thus, a base tube for machining which has an outer diameter of 30.3 mm, an inner diameter of 28.0 mm, and a total length of 367 mm is prepared.

Mating portions are formed in the respective ends of the base tube while the outer surface of the base tube is held. The mating portions have an inner diameter of 28.5 mm and a depth of 10 mm. The base tube is further chamfered. The chamfered tube has a total length of 365 mm.

The base tube in which mating portions have been formed is subjected to outer-diameter machining with a lathe "SPA5" produced by Shoun Machine Tool Co., Ltd. The outer diameter of the base tube is reduced to 30 mm with a tool bit including a polycrystalline diamond blade while the amount of feed of the tool bit per revolution of the main shaft is controlled.

The outer periphery of the conductive substrate is measured with a surface roughness gage "SURFCOM 1400" produced by TOKYO SEIMITSU CO., LTD. in order to determine the mean width of the waviness profile WSm ("WSm" in Table 1) and the arithmetic mean height Wa of waviness profiles ("Wa" in Table 1). Specifically, the mean width of the waviness profile WSm and the arithmetic mean height Wa of waviness profiles are measured at three positions on the outer periphery of the conductive substrate, and the average of the mean width of the waviness profiles and the average of the arithmetic mean heights of waviness profiles are considered to be WSm and Wa, respectively. Table 1 summarizes the results.

Formation of Undercoat Layer

With 100 parts by weight of zinc oxide "MZ300" produced by TAYCA CORPORATION, 10 parts by weight of a 10-weight % toluene solution of 3-(2-aminoethylamino) propyltriethoxysilane, which serves as a silane coupling agent, and 200 parts by weight of toluene are mixed. The resulting mixture is stirred and refluxed for two hours. Subsequently, toluene is distilled away under a reduced pressure of 10 mmHg, and baking is performed at 135° C. for 2 hours. Thus, surface-treated zinc oxide particles are prepared.

With 33 parts by weight of the surface-treated zinc oxide particles, 6 parts by weight of blocked isocyanate "Sumidur 3175" produced by Sumitomo Bayer Urethane Co., Ltd., which serves as a curing agent, 1 part by weight of the electron-accepting compound represented by Structural Formula (1) below, and 25 parts by weight of methyl ethyl ketone are mixed for 30 minutes. To the resulting mixture, 5 parts by weight of a butyral resin "S-LEC BM-1" produced by Sekisui Chemical Co. Ltd., which serves as a binder resin, 3 parts by weight of silicone beads "Tospearl 120" produced by Momentive Performance Materials Inc., and 0.01 parts by weight of a silicone oil "SH29PA" produced by Dow Corning Toray Silicone Co., Ltd., which serves as a leveling agent, are added. The resulting mixture is dispersed for three hours with a sand mill to form an undercoat-layer-forming coating liquid.

(1)

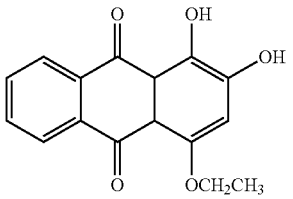

The undercoat-layer-forming coating liquid is applied onto the outer periphery of the conductive substrate by dip coating. The resulting coating film is dried at 180° C. for 30 minutes and cured to form an undercoat layer having a thickness of 25 μm on the conductive support.

Formation of Charge-Generating Layer

As a charge-generating material, a hydroxygallium phthalocyanine pigment having a strong diffraction peak at, at least, Bragg angles (2θ±0.2°) of 7.5°, 9.9°, 12.5°, 16.3°, 18.6°, 25.1°, and 28.3° in an X-ray diffraction spectrum measured with the CuKα radiation is prepared. The hydroxygallium phthalocyanine pigment, a vinyl chloride-vinyl acetate copolymer "VMCH" produced by Nippon Unicar Company Limited, which serves as a binder resin, and n-butyl acetate, which serves as a solvent, are mixed together. The resulting mixture and glass beads having a diameter of 1.0 mm are charged into a glass bottle having a capacity of 100 mL at a filling proportion of 50%. The mixture is dispersed for 2.5 hours with a paint shaker to form a charge-generating-layer-forming coating liquid.

The content of the hydroxygallium phthalocyanine pigment in the mixture of the hydroxygallium phthalocyanine pigment and the vinyl chloride-vinyl acetate copolymer is 55.0% by volume. The solid content in the charge-generating-layer-forming coating liquid is 6.0% by weight. In the calculation of the content of the hydroxygallium phthalocyanine pigment, the specific gravities of the hydroxygallium phthalocyanine pigment and the vinyl chloride-vinyl acetate copolymer are assumed to be 1.606 g/cm$^3$ and 1.35 g/cm$^3$, respectively.

The charge-generating-layer-forming coating liquid is applied to the undercoat layer by dip coating. The resulting coating film is dried at 100° C. for 5 minutes to form a charge-generating layer having a thickness of 0.20 μm on the under coating layer.

Formation of Charge-Transporting Layer

A charge-transporting layer-forming coating liquid is prepared by dissolving 8 parts by weight of the compound represented by General Formula (CT1) below (where $R^{C11}$ to $R^{C14}$ each represent 4-$CH_3$, $R^{C15}$ and $R^{C16}$ each represent a hydrogen atom, and m and n are 1), which serves as a charge-transporting material, 32 parts by weight of the compound represented by General Formula (CT2) below (where $R^{C21}$ to $R^{C23}$ each represent a hydrogen atom), which serves as a charge-transporting material, 60 parts by weight of a bisphenol-Z-based polycarbonate resin (viscosity-average molecular weight: 40,000), and 3.2 parts by weight (8.0% by weight of the total amount of charge-transporting materials) of a hindered phenol antioxidant represented by Structural Formula (HP-1) below (molecular weight: 775) in 340 parts by weight of tetrahydrofuran.

The charge-transporting layer-forming coating liquid is applied to the charge-generating layer by dip coating. After an excess portion of the coating film has been removed, the coating film is dried at 150° C. for 40 minutes to form a charge-transporting layer having a thickness of 26 μm.

(CT1)

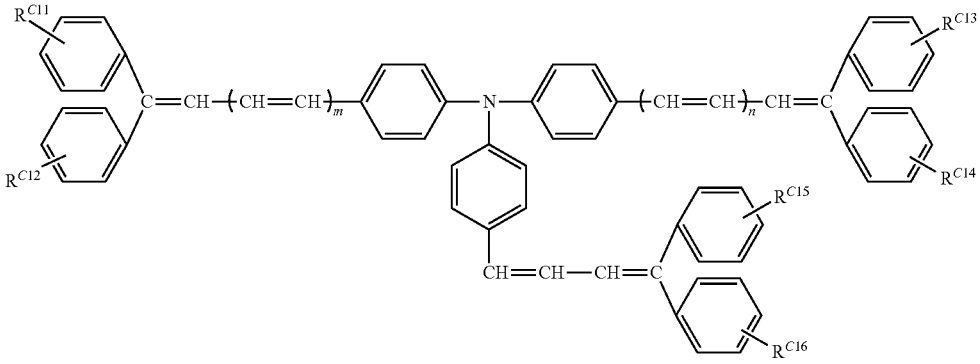

(CT2)

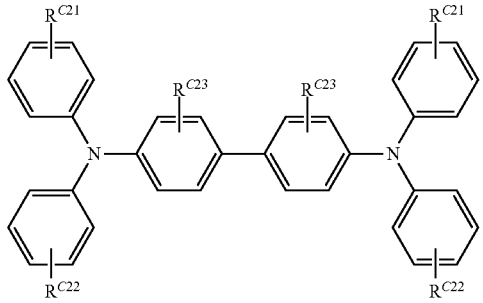

-continued (HP-1)

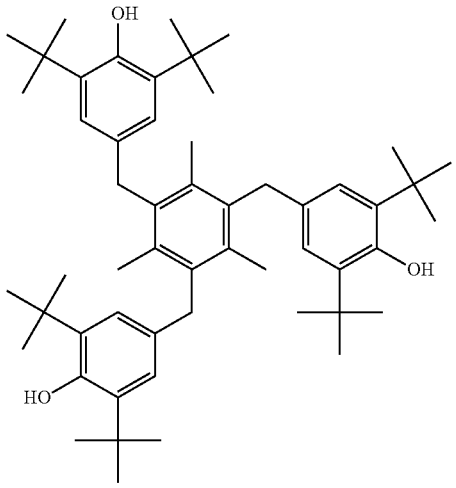

A photoreceptor 1 including a conductive substrate, an undercoat layer, a charge-generating layer, and a charge-transporting layer is prepared in the above-described manner.

Preparation of Photoreceptors 2 to 5

Photoreceptors 2 to 5 are prepared as in the preparation of the photoreceptor 1, except that WSm and Wa of the conductive substrate in the preparation of the conductive substrate of the photoreceptor 1 are changed as shown in Table 1.

Evaluations

With a modification of an image-forming apparatus "ApeosPort-V C7775" produced by Fuji Xerox Co., Ltd. which includes a specific one of the photoreceptors shown in Table 1 and an exposure device having a specific one of the arrangement intervals shown in Table 1, halftone images having an image density of 50% are formed on an A3-size paper sheet. For forming the halftone images, screens having 150 and 300 lines per inch are used.

The halftone images are visually inspected for inconsistencies in image density in accordance with the following criteria. Halftone images evaluated as "A" or "B" are considered to be at a practical level. Table 1 summarizes the results.

A: The halftone image formed with a screen having 300 lines per inch is at an acceptable level in terms of image quality.

B: The halftone image formed with a screen having 150 lines per inch is at an acceptable level in terms of image quality.

C: The occurrence of banded inconsistencies in image density is confirmed in the halftone image formed with a screen having 150 lines per inch.

TABLE 1

| | Photoreceptor | | | Exposure device | | |
|---|---|---|---|---|---|---|
| | No. | WSm (μm) | Wa (μm) | No. | Arrangement interval (μm) | Evaluation |
| Example A1 | 1 | 350 | 0.10 | 1 | 400 | A |
| Comparative example A2 | 2 | 400 | 0.15 | 1 | 400 | C |
| Comparative example A3 | 3 | 500 | 0.2 | 1 | 400 | C |

TABLE 1-continued

| | Photoreceptor | | | Exposure device | | |
|---|---|---|---|---|---|---|
| | No. | WSm (μm) | Wa (μm) | No. | Arrangement interval (μm) | Evaluation |
| Comparative example A4 | 4 | 600 | 0.25 | 1 | 400 | C |
| Comparative example A5 | 5 | 800 | 0.3 | 1 | 400 | C |
| Example B1 | 1 | 350 | 0.10 | 2 | 500 | A |
| Example B2 | 2 | 400 | 0.15 | 2 | 500 | A |
| Comparative example B3 | 3 | 500 | 0.2 | 2 | 500 | C |
| Comparative example B4 | 4 | 600 | 0.25 | 2 | 500 | C |
| Comparative example B5 | 5 | 800 | 0.3 | 2 | 500 | C |
| Example C1 | 1 | 350 | 0.10 | 3 | 600 | A |
| Example C2 | 2 | 400 | 0.15 | 3 | 600 | A |
| Example C3 | 3 | 500 | 0.2 | 3 | 600 | A |
| Comparative example C4 | 4 | 600 | 0.25 | 3 | 600 | C |
| Comparative example C5 | 5 | 800 | 0.3 | 3 | 600 | C |
| Example D1 | 1 | 350 | 0.10 | 4 | 800 | A |
| Example D2 | 2 | 400 | 0.15 | 4 | 800 | B |
| Example D3 | 3 | 500 | 0.2 | 4 | 800 | A |
| Example D4 | 4 | 600 | 0.25 | 4 | 800 | A |
| Comparative example D5 | 5 | 800 | 0.3 | 4 | 800 | C |

The above results confirm that the image-forming apparatuses prepared in Examples reduce the occurrence of banded inconsistencies in image density compared with those prepared in Comparative examples.

In Comparative examples A3, A4, B4, B5, and C5, the arithmetic mean height Wa of waviness profiles is large compared with Examples, since the mean width of the waviness profile WSm is large. It is considered that this increases the likelihood of the occurrence of banded inconsistencies in image density and that an increase in the number of lines of the screen further increases the likelihood of the occurrence of banded inconsistencies in image density.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

an electrophotographic photoreceptor including a conductive substrate, and a photosensitive layer disposed on the conductive substrate;

a charging device that charges a surface of the electrophotographic photoreceptor;

an exposure device that forms an electrostatic latent image on the charged surface of the electrophotographic photoreceptor by irradiating the charged surface of the electrophotographic photoreceptor with light, the exposure device including a plurality of light sources arranged in an axial direction of the electrophotographic photoreceptor;

a developing device including a developer including a toner, the developing device forming a toner image on the surface of the electrophotographic photoreceptor by developing the electrostatic latent image formed on the surface of the electrophotographic photoreceptor with the developer; and a transfer device that transfers the toner image formed on the surface of the electrophotographic photoreceptor onto a surface of a recording medium, wherein a mean width WSm of waviness profiles of an outer periphery of the conductive substrate is smaller than an interval at which the light sources are arranged in the axial direction of the electrophotographic photoreceptor, the mean width WSm being determined in accordance with JIS B0601 (2001).

2. The image-forming apparatus according to claim 1, wherein the mean width WSm of the waviness profiles of the outer periphery of the conductive substrate is 0.9 times or less the interval at which the light sources are arranged in the axial direction of the electrophotographic photoreceptor.

3. The image-forming apparatus according to claim 2, wherein the mean width WSm of the waviness profiles of the outer periphery of the conductive substrate is 0.7 times or more and 0.8 times or less the interval at which the light sources are arranged in the axial direction of the electrophotographic photoreceptor.

4. The image-forming apparatus according to claim 1, wherein the mean width WSm of the waviness profiles of the outer periphery of the conductive substrate is 300 μm or more and 550 μm or less.

5. The image-forming apparatus according to claim 1, wherein an arithmetic mean height Wa of the waviness profiles of the outer periphery of the conductive substrate is 0.4 or less.

6. The image-forming apparatus according to claim 1, wherein the exposure device includes a light-emitting element array including a plurality of light-emitting elements.

7. A process cartridge detachably attachable to an image-forming apparatus, the process cartridge comprising:

an electrophotographic photoreceptor including a conductive substrate, and a photosensitive layer disposed on the conductive substrate; and an exposure device that forms an electrostatic latent image on a charged surface of the electrophotographic photoreceptor by irradiating the charged surface of the electrophotographic photoreceptor with light, the exposure device including a plurality of light sources arranged in an axial direction of the electrophotographic photoreceptor, wherein a mean width WSm of waviness profiles of an outer periphery of the conductive substrate is smaller than an interval at which the light sources are arranged in the axial direction of the electrophotographic photoreceptor, the mean width WSm being determined in accordance with JIS B0601 (2001).

8. The process cartridge according to claim 7, wherein the mean width WSm of the waviness profiles of the outer periphery of the conductive substrate is 0.9 times or less the interval at which the light sources are arranged in the axial direction of the electrophotographic photoreceptor.

9. The process cartridge according to claim 8, wherein the mean width WSm of the waviness profiles of the outer periphery of the conductive substrate is 0.7 times or more and 0.8 times or less the interval at which the light sources are arranged in the axial direction of the electrophotographic photoreceptor.

10. The process cartridge according to claim 7, wherein the mean width WSm of the waviness profiles of the outer periphery of the conductive substrate is 300 μm or more and 550 μm or less.

11. The process cartridge according to claim 7, wherein an arithmetic mean height Wa of the waviness profiles of the outer periphery of the conductive substrate is 0.4 or less.

12. The process cartridge according to claim 7, wherein the exposure device includes a light-emitting element array including a plurality of light-emitting elements.

* * * * *